United States Patent [19]

Rasmason

[11] 4,154,542

[45] May 15, 1979

[54] SHOWER MITT

[76] Inventor: Arthur V. Rasmason, P.O. Box 4, Stewart's Point, Calif. 95480

[21] Appl. No.: 885,650

[22] Filed: Mar. 13, 1978

[51] Int. Cl.[2] ..... A47K 7/03

[52] U.S. Cl. ..... 401/7; 15/227

[58] Field of Search ..... 15/227, 104.94; 2/158; 401/6–8, 200, 201

[56] References Cited

U.S. PATENT DOCUMENTS

| | | | |
|---|---|---|---|
| 1,351,311 | 8/1920 | Virneburg | 401/8 |
| 1,941,320 | 12/1933 | Pamplin | 401/7 |
| 1,970,081 | 8/1934 | Eisendrath | 2/158 |
| 1,999,753 | 4/1935 | Diemer | 15/227 |
| 2,363,697 | 11/1944 | Schirmer | 401/7 |
| 3,711,889 | 1/1973 | Jennings | 2/158 X |

FOREIGN PATENT DOCUMENTS

| | | | |
|---|---|---|---|
| 541537 | 10/1955 | Belgium | 401/201 |
| 119582 | 4/1927 | Switzerland | 2/158 |

*Primary Examiner*—Daniel Blum

*Attorney, Agent, or Firm*—Owen, Wickersham & Erickson

[57] ABSTRACT

A shower mitt with two flat sheets of terry cloth double-seamed together around the outline edge to provide a hand-receiving pocket in which there is an elastic band to provide wrist-hugging. A pair of loops are stitched into the seam between the flat sheets. A wide mesh sheet of nylon net is attached around its edges to the outer face of one sheet to provide a fully enclosed soap-retaining pocket, in which an opening is cut through the sheet and a zipper placed therein, so that it may be opened for putting soap into the soap-retaining pocket and then closed.

1 Claim, 3 Drawing Figures

SHOWER MITT

BACKGROUND OF THE INVENTION

This invention relates to an improved shower mitt.

Various shower mitts have been proposed before, but none of them seem to provide a completely adequate piece of equipment.

Many of them provide for a soap pocket but locate it so that the soap lather must be worked through a thick cloth layer. Many of them are impractical to manufacture, while impractical to use. In many it is awkward to install the soap in its pocket. Others provide no washcloth portion.

An object of the present invention is to provide a shower mitt with soap retention means that makes it very easy to take a shower and to scrub one's body thoroughly.

Another object is to provide a shower mitt which can be used by people who are engaged in jobs that get them very dirty, such as farming or logging--outdoor jobs that embody considerable contact with dirt so that ordinary light showers are quite insufficient.

Another object of the invention is to provide a shower mitt in which the soap is separated from the user's hand and yet is very easily installed into its active position.

Another object is to provide a mitt that both holds the soap securely and places it where it can directly touch the body of the user.

SUMMARY OF THE INVENTION

The shower mitt of the invention is made from suitable washcloth material, such as terry cloth, preferably by two sheets cut to a general hand-outline shape and then seamed together around the edge. This provides a hand-receiving pocket with an open end, and near the open end an elastic band is sewn on to provide a wrist-hugging and also elastically enlargeable entrance to the pocket. So that the mitt can easily be hung upon a rock, one or more loops are preferably provided by stitching a strip into the seam between the two flat sheets.

A wide-mesh sheet of nylon net is attached around its edges to the outer face of one of the sheets, as by sewing, to provide a fully enclosed, soap-retaining pocket. The sheet that forms the bottom surface of the pocket is cut or slit to provide an opening, and in this opening a zipper or other suitable closure is provided, preferably having its handle manipulated from inside the hand-receiving pocket. Thus, the two pockets are normally separated from each other and only are joined together when the zipper is opened purposely. A bar of soap is insertable through the opening when the zipper is opened, and the pocket is then closed. The soap, being well exposed by virtue of the wide mesh net is available for nearly direct application to the body, and in fact the net itself improves the scrubbing action. On the other hand, a simple reversal of the hand inside the mitt places a washcloth material on the palm.

Other objects and advantages of the invention will appear from the following description of a preferred embodiment.

DESCRIPTION OF A PREFERRED EMBODIMENT

Figure 2:
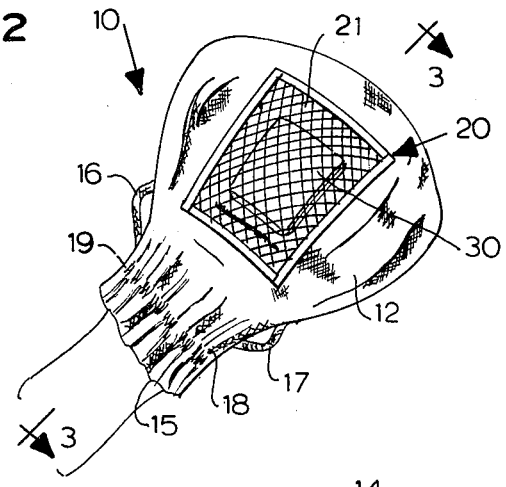
FIG. 2 is a view in perspective of a shower mitt as it is used, with a portion of a person's arm projecting out from it.
Figure 1:
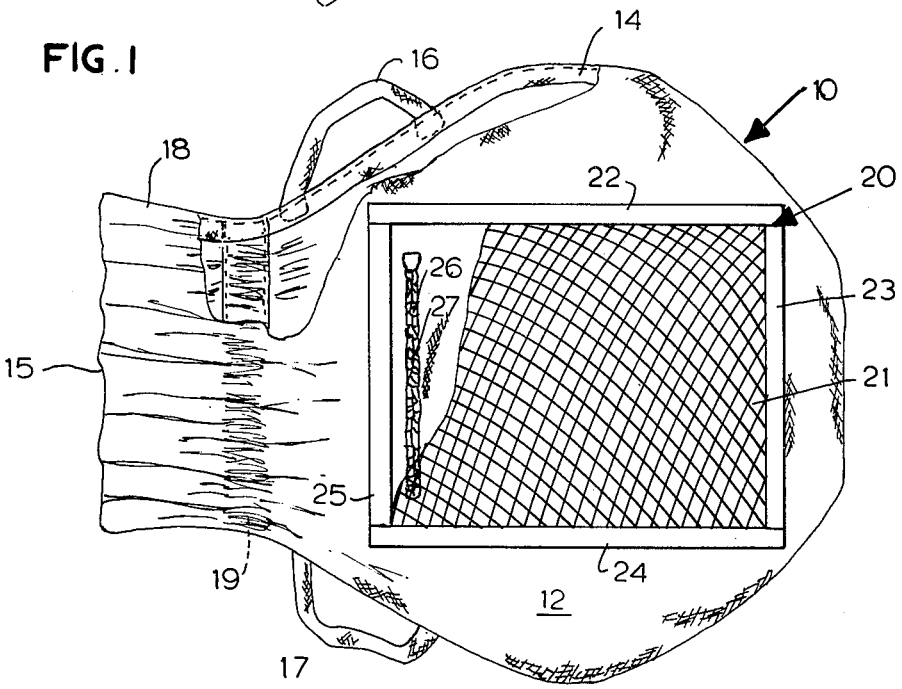
FIG. 1 is a plan view of a mitt embodying the principles of the invention with the net in part broken away to show the zipper and mitt surface beneath it.

A shower mitt 10 is shown in the drawing as an example of this invention. Several different sizes can be made to correspond to the sizes of children, of women, of men, and of very large men, for example, but the general scheme is approximately the same. Some differences in outline are also quite feasible, though there again, the main thing is to obtain a general outline of a hand and to provide the shape so that there can be a hand-receiving pocket 11 in it, suitable to receive the hand of the user in a comfortable position.

As the invention shows, the mitt 10 is preferably made from two sheets 12 and 13 of terry cloth or similar material, each sheet 12, 13 having a general outline of the approximate shape and size of the hand and enough larger to enable insertion of the hand in the pocket 11 between them. The sheets 12 and 13 are seamed together around the edges, preferably by a double seam 14, leaving an end portion 15 open for insertion of the hand into the pocket 11. Included in the stitch 14 and secured by it is at least one, and preferably two, strips 16, 17 which may be also of terry cloth or the same material as the main part of the mitt 10, to provide a pair of loops for hanging the mitt 10 on a hook.

Figure 3:
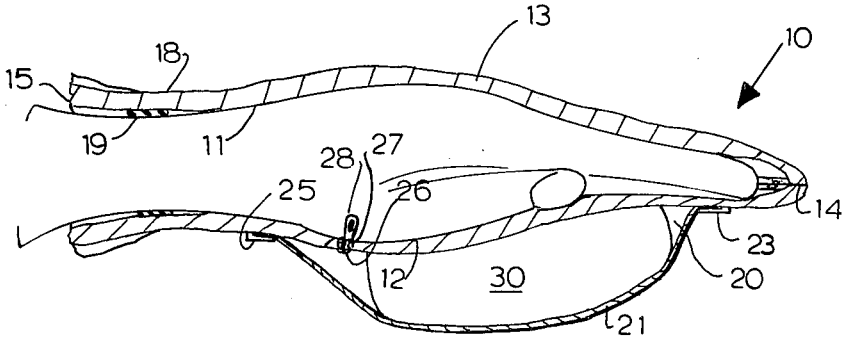
FIG. 3 is an enlarged view in section taken along the line 3—3 in FIG. 2.

A short cuff portion 18 is provided inside of which is stitched a strip 19 of elastic material so that it can be spread apart for inserting the hand into the pocket 11 and will then come back together and generally hug the user's wrist. This hugging action makes it easy to use the mitt and to maintain desired alignment. Thus, one's hand may be inserted into the pocket 11, as shown in FIG. 3, so that the hand is substantially enclosed by the terry cloth mitt 10. There need be no separation of thumb from fingers, and it in fact is considered preferable to have them all together in the same compartment 11.

A separate soap-retaining pocket 20 is also provided by securing to the sheet 12 a preferably rectangular piece of wide mesh nylon mitt 21. The securing may be accomplished by stitching four strips 22, 23, 24 and 25 of cloth tape of suitable strength to the sheet 12 with net 21 held by the stitch. Four inch strips 22, 23, 24, and 25 make the pocket 20 rectangular--it may be some other shape, if desired, but since most soap bars are approximately rectangular, that is generally the better practice. The openings in the mesh 21 should be wide, for example, about an eighth of an inch, with very little of the surface being taken up by the thread. By using a material such as nylon, a somewhat coarse effect is obtained while at the same time providing great strength and durability.

An opening into the soap-receiving pocket 20 is provided by slitting the sheet 12 near one end of the soap-receiving pocket to provide an opening 26 and then stitching into it to the interior surface a suitable zipper 27 of plastic or metal, with its handle on the inside of the hand-receiving pocket 11. The zipper handle 28 is there readily accessible so that it may be opened, a soap bar 30 inserted, and the zipper 27 pulled closed.

In use, the user can soap his body fully directly from the soap bar 30 in the pocket 20, and he can reverse the mitt 10 to use the sheet 13 as a soap-free washcloth.

Among the advantages of the mitt as I have described it are the following:

The soap and the washcloth stay together, so that the soap doesn't slip out of one's hand, so that the bather doesn't have to lay it down while using the washcloth, and so that the soap won't slide off a soap dish and get lost on the floor or in a tub.

When the mitt is reversed, the washcloth is ready for use in scrubbing the body; moreover, with the bather's hand in the mitt, the washcloth doesn't roll up in a ball, as ordinary washcloths sometimes do.

When the soap is being used, the nylon pocket and soap cooperate to remove dead skin, which is usually present on people who have been working hard outdoors. Moreover, quantities of soap lather are easily obtained, and I find that this combination of soap and nylon net helps in scrubbing, cleaning out the pores in the skin much better than one can do with a bar of soap alone or with a soapy washcloth.

Besides, one doesn't forget to take the soap from his locker into a shower room.

The invention is particularly helpful as mentioned, to those who engage in strenuous physical work, especially in dirty places. This applies to farmers, loggers, construction workers, athletes, coal miners, forest-fire fighters, and many others.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A shower mitt, including in combination:

two flat sheets of terry cloth cut to general handout-line shape and double-seamed together around the edge to provide a hand-receiving pocket having an open end and free from subdivisions, an elastic band sewn to the interior face at the open end of the pocket to provide a wrist-hugging and elastically enlargeable entrance to the pocket, a pair of cloth strips the ends of which are stitched into the seam between the flat sheets at spaced locations between the wrist portion and the middle of the hand-receiving pocket and projecting out to provide loops, a wide mesh sheet of nylon net attached around its edges to the outer face of one said terry cloth sheet to provide a fully enclosed soap-retaining pocket, said latter terry cloth sheet being cut to provide an opening therethrough to enable insertion of a bar of soap from said hand-receiving pocket into said soap-retaining pocket, and a zipper for opening and closing said cut opening, having a handle manipulated from inside said hand-receiving pocket.

* * * * *